US008510998B1

(12) United States Patent
Martinez

(10) Patent No.: US 8,510,998 B1
(45) Date of Patent: Aug. 20, 2013

(54) ANTI-THEFT APPARATUS

(75) Inventor: Henry Martinez, Blue Island, IL (US)

(73) Assignee: Gorilla Cages, Inc., Blue Island, IL (US)

( * ) Notice: Subject to any disclaimer, the term of this patent is extended or adjusted under 35 U.S.C. 154(b) by 49 days.

(21) Appl. No.: 13/416,888

(22) Filed: Mar. 9, 2012

(51) Int. Cl.
*B62D 63/04* (2006.01)
*E04D 1/34* (2006.01)

(52) U.S. Cl.
USPC ..... 52/3; 52/4; 52/5

(58) Field of Classification Search
USPC ..... 52/3–5, 23, 106; 160/218–222; 135/87, 913; 150/154, 157, 165
See application file for complete search history.

(56) References Cited

U.S. PATENT DOCUMENTS

| | | | | |
|---|---|---|---|---|
| 2,914,075 | A * | 11/1959 | Wells et al. | 62/331 |
| 4,730,423 | A * | 3/1988 | Hughes | 135/87 |
| 5,226,264 | A * | 7/1993 | Walters | 52/63 |
| 6,138,993 | A * | 10/2000 | Mitchell et al. | 256/25 |
| 6,158,175 | A * | 12/2000 | Carter | 52/79.5 |
| 6,186,158 | B1 * | 2/2001 | Goarin | 135/128 |
| 6,430,954 | B1 * | 8/2002 | Smith | 62/259.1 |
| 6,595,017 | B1 * | 7/2003 | Teahan | 62/259.1 |
| 7,836,653 | B1 * | 11/2010 | Herrington | 52/473 |
| 8,137,769 | B1 * | 3/2012 | Copeland | 428/18 |
| 2002/0096265 | A1 * | 7/2002 | Bertheaume et al. | 160/10 |
| 2003/0177704 | A1 * | 9/2003 | Forbis et al. | 52/3 |
| 2010/0058688 | A1 * | 3/2010 | Goddard | 52/238.1 |

OTHER PUBLICATIONS

Gorilla Cages When security counts, we've got you covered; [online], Houston Irrigation Services, [retrieved on Mar. 9, 2012] Retrieved from the Internet: <URL: http:\\www.gorillacages.com >; 5 pages.

* cited by examiner

*Primary Examiner* — Mark Wendell
(74) *Attorney, Agent, or Firm* — Neal, Gerber & Eisenberg LLP

(57) ABSTRACT

Embodiments of an anti-theft apparatus for deterring theft of an article is disclosed. In one embodiment, an anti-theft apparatus comprises a post and a cage removably lockable to and cantileverly extendable from the post for removably enclosing at least a portion of the article to be protected from theft. The cage comprises a top portion formed from a plurality of top members and a plurality of side members extending downwardly from respective outer ends of the top members, and a plurality of spaced apart bands oriented approximately perpendicularly and connected to respective side members of the top portion.

20 Claims, 8 Drawing Sheets

ANTI-THEFT APPARATUS

BACKGROUND

This application relates generally to security systems, and particularly to an anti-theft apparatus and systems configured to deter and prevent theft of articles, such as outdoor air conditioner units, among other items of value.

Precious metals of all types have for some time been the target of thieves. A common example is the platinum used in the construction of catalytic converters for use in automobile exhaust systems. As prices increase for commodity materials, such as metals and plastics, and especially, copper, stainless steel and the like, there exists an increasing potential for theft of literally anything for purposes of selling the stolen goods for their scrap value. For example, outdoor air conditioner units having a heat exchanger coil and refrigerant compressor are increasingly becoming targets for theft due to the scrap value of the materials in these units. Theft of these units can occur at the homes and businesses and wherever such units or other items of value are accessible to thieves, only to be sold to recycling centers for their scrap value based on the weight of copper and other metal in the units, resulting in significant loss to the homeowner. Although security devices of all sorts are known to exist, none include security features coupled with easy installation, easy access to air conditioner components without having to remove the apparatus, and easy removal of the apparatus to make more invasive repairs or total replacement of air conditioner unit.

What is needed, therefore, is an anti-theft apparatus for articles having commodity materials that are increasingly being stolen and sold for their scrap value.

SUMMARY

An anti-theft apparatus for deterring theft of an outdoor air conditioner unit is disclosed, comprising a post and a cage removably lockable to and cantileverly extendable from the post for removably enclosing at least a portion of the air conditioner unit. The cage comprises a top portion formed from a plurality of top members and a plurality of side members extending downwardly from respective outer ends of the top members, and a plurality of spaced apart bands oriented approximately perpendicularly and connected to respective side members of the top portion.

The cage may include a sleeve from which the cage may be cantilevered therefrom, the sleeve having an aperture for receiving the post therethrough. The top members, the side members, and the spaced apart bands may be formed from four-sided bars. An inner end of each of the top members may be welded in facing association with one another. An outer end of each of the top members may be welded to an upper end of each of the side members. The spaced apart bands may be welded to each of the side members. One of the spaced apart bands may be welded to a bottom end of each of the side members.

The anti-theft apparatus may further include a lock removably engageable with an end of a pin that is positionable through an aperture in the cage and in the post. A cantilevered portion of the cage may provide tamper resistant access to the lock.

The post may be embeddable in a concrete base or may be mountable to the concrete base using a plurality of anchors. If mounted to a concrete base using anchors, such as threaded studs in combination with nuts, the anti-theft apparatus may include an anchor cover for concealing the anchors when the anchor cover is installed over the post. The anchor cover may be positionable between the concrete base and the cage to provide a pedestal for the cage. The anti-theft apparatus may further include a plurality of cantilevered members extending from a sleeve of the cage to the top portion of the cage.

In another embodiment, an anti-theft apparatus for deterring theft of an outdoor air conditioner unit is disclosed comprising a post mounted to a base in proximity to the unit by a plurality of fasteners, a cover comprising a first sleeve extending from an enclosure, the cover positioned on the post via the first sleeve, the cover in mated association with the base for concealing the plurality of fasteners by the enclosure, and a cage for removably enclosing at least a portion of the air conditioner unit. The cage comprises a second sleeve positioned on the post, the second sleeve comprising a bottom surface in mated association with a top surface of the first sleeve. The cage is cantileverly extending from the post by a plurality of cantilevered members attached to the second sleeve. The cage further comprises a top portion formed from a plurality of top members and a plurality of side members extending downwardly from respective outer ends of the top members, and a plurality of spaced apart bands oriented approximately horizontally and connected to respective side members of the top portion. The anti-theft apparatus includes a pin removably engaged in aligned apertures in the second sleeve and the post, and a lock removably engaged to an end of the pin. The end of the pin and the lock is positioned between two of the cantilevered members to provide a tamper resistant obstruction for the lock.

An inner end of each of the top members may be in facing association with one another. The post may have at least one facet nested with at least one facet on each of the first and second sleeves. The anti-theft apparatus may further comprise at least one plate connecting at least two cantilevered members to one another and at least one pad positioned on internal surfaces of the top portion or the spaced apart bands to protect the unit from being scratched.

In another embodiment, an anti-theft apparatus for deterring theft of an outdoor air conditioner unit is disclosed comprising a post anchorable to a ground in proximity to the unit, a cage, and a locking device configured to removably retain the cage upon the post. The cage comprises a first sleeve for receiving the post therethrough, a top portion formed from a plurality of top members and a plurality of side members extending downwardly from respective outer ends of the top members, a plurality of spaced apart bands oriented approximately perpendicularly to and connected to each of side members of the top portion, and a plurality of cantilevered arms connected to the first sleeve and one of the side members for cantileverly supporting the cage to enclose at least a portion of the unit.

The anti-theft apparatus may further comprise a pedestal having a second sleeve for receiving the post therethrough, the pedestal being configured for adjusting an installed height of the cage over the unit. A portion of the locking device may be positioned between at least two of the cantilevered arms.

DETAILED DESCRIPTION

Figure 1:
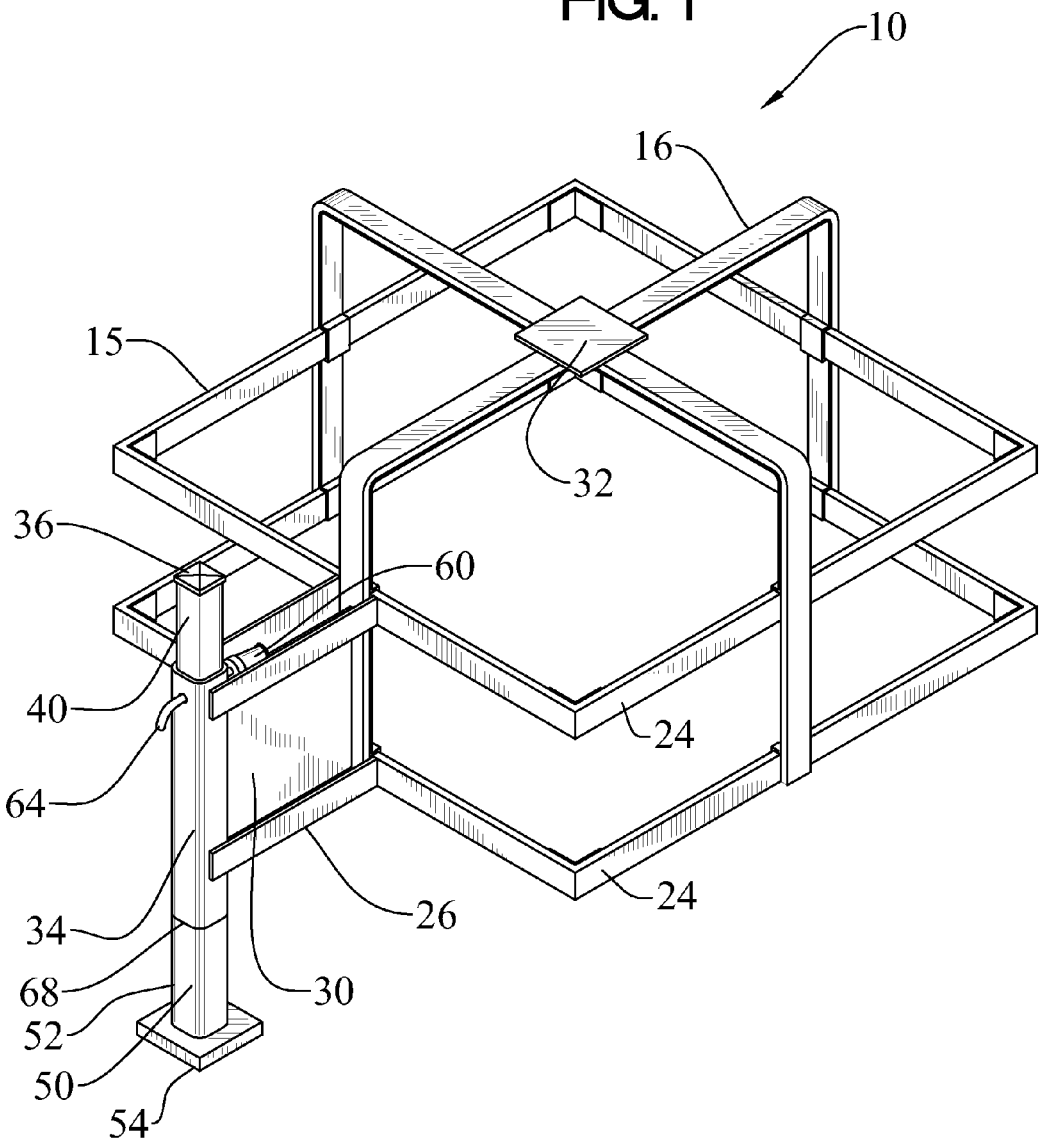
FIG. 1 is a perspective view of one embodiment of an anti-theft apparatus.

Although the figures and the instant disclosure describe one or more embodiments of an anti-theft apparatus for outside air conditioner units, one of ordinary skill in the art would appreciate that the teachings of the instant disclosure would not be limited to such uses, and instead would also have utility to secure and deter theft of permanently installed items, such as backup power generators, storage boxes, and the like. While the instant disclosure relates to anti-theft apparatus and systems generally, it will be better understood within the discussion of exemplary embodiments directed to an apparatus for deterring theft of residential or commercial outdoor air conditioning units.

Turning now to the figures, wherein like reference numerals refer to like elements, FIGS. 1-4 show an exemplary anti-theft apparatus 10 for deterring theft of an article, such as a residential or a commercial outdoor air conditioner unit. Anti-theft apparatus 10 comprises cage 15 configured to at least partially enclose the article, such as a residential or commercial outdoor air conditioner unit, while permitting access to, for example, maintain the article when anti-theft apparatus 10 is installed. Anti-theft apparatus 10 is additionally configured, as described more fully below, for easy initial installation of and for easy disassembly or removal of at least a portion of anti-theft apparatus 10, such as cage 15, to permit maintenance of one or more aspects of the article, such as replacement of an air compressor or of a condenser coil, which are typically enclosed in a housing of an air conditioner unit.

Cage 15 includes top portion 16, one or more bands 24, one or more cantilevered members 26, and sleeve 34. Cantilevered members 26 are configured for connecting top portion 16 and the one or more bands 24 to sleeve 34. Top portion 16 comprises at least two top members 20, with respective outer ends 21 of each top member 20 connected to side member 22. Top members 20 may be oriented generally parallel to one another, generally perpendicular to one another, generally at an angle to one another, or in any manner to form a ceiling over the intended article to be protected against theft, such as an outdoor air conditioner unit, when cage 15 is securely connected to ground or to a nearby structure. Cantilevered members 26 may be directly connected to side members 22, to one or more bands 24, or both.

In one embodiment, as shown in FIG. 1, top portion 16 comprises four top members 20 arranged with respective inner ends 19 connected together at a generally central location of top portion 16 and with respective outer ends 21 connected to respective side members 22 to form two intersecting U-shaped members 18 oriented generally perpendicularly to one another when viewed from the top of cage 15. The open end of U-shaped members 18 is oriented downward to at least partially enclose a top portion of an article to be protected against theft. Top portion 16 may include plate 32 for connecting inner ends 19 together and for adding structural strength at the intersection of top members 20. Plate 32 may also be a suitable location for displaying, for example, a company's logo or other indicia.

Top portion 16 may be configured to limit obstructing the top or side of an article to be protected to allow the article to perform its intended function. If used in connection with deterring theft of an outdoor air conditioner unit, for example, top portion 16 may be configured in the manner shown and described to limit obstructing the discharge of air coming from the fan located within an outdoor air conditioner unit.

Ends 23 of side members 22 may be connected to one band 24, such as a band positioned at the bottom of cage 15, as shown in the embodiment of FIG. 1. In another embodiment, ends 23 of side members 22 may extend beyond and/or below the lowest positioned one of bands 24.

Figure 5:
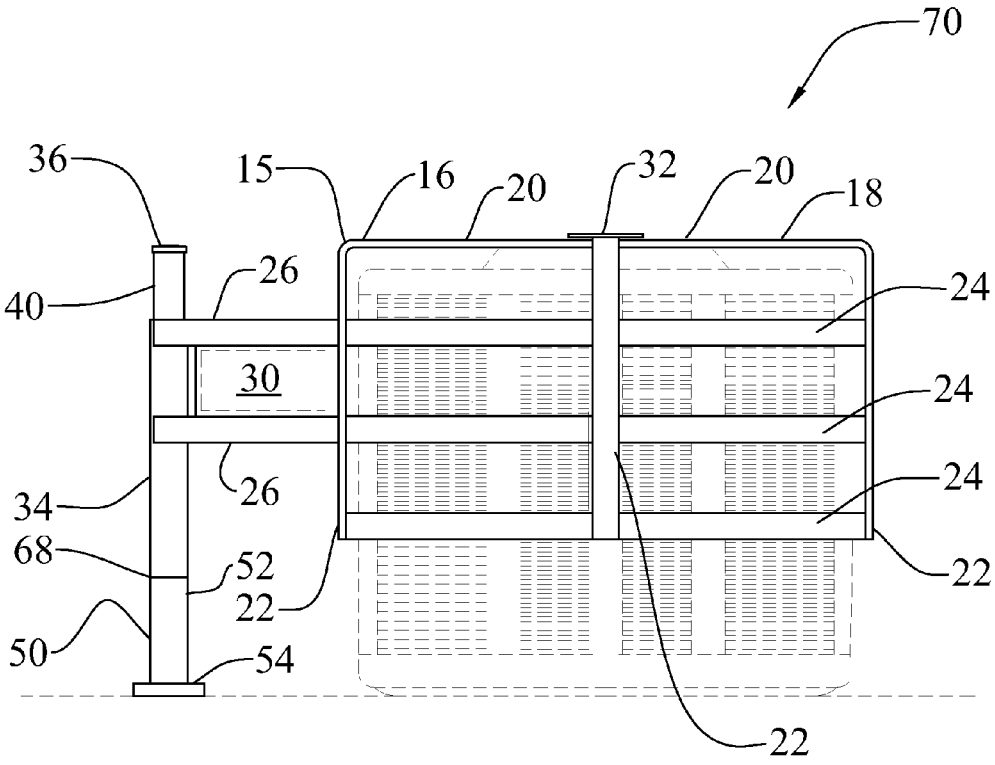
FIG. 5 is a side elevation view of another embodiment of an anti-theft apparatus.
Figure 6:
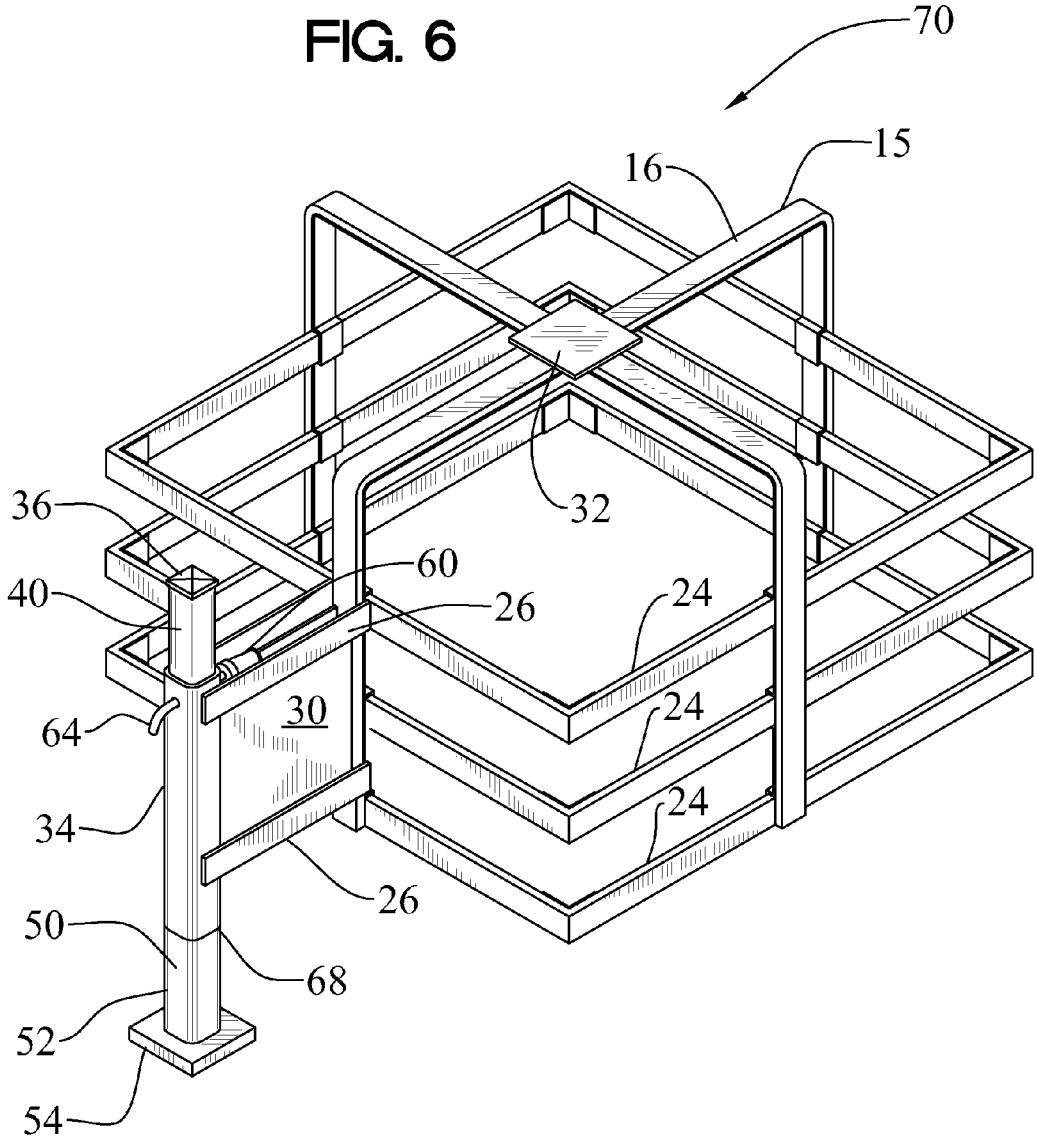
FIG. 6 is a perspective view of the embodiment shown in FIG. 5.
Figure 7:
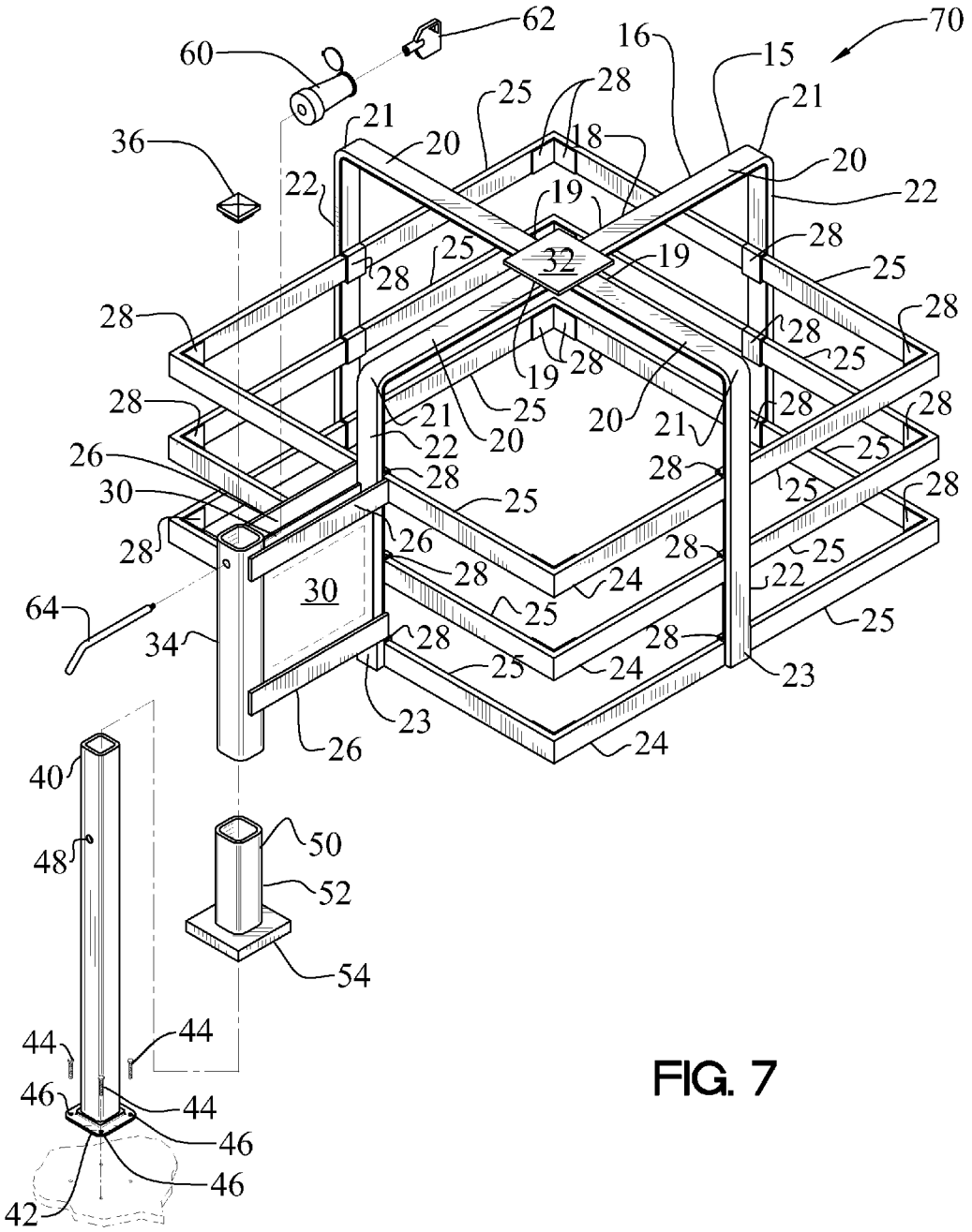
FIG. 7 is an exploded perspective view of the embodiment shown in FIG. 5.

If cage 15 includes two or more bands 24, they may be spaced apart as shown in the figures. In addition, if cage 15 includes two or more bands 24, side members 22 may be connected to one or more of bands 24 that are positioned anywhere along the length of side members 22 and above a bottom-most band 24 connected at or near respective ends 23 of side members 22. In one embodiment, as shown in FIGS. 5-7, cage 15 of anti-theft apparatus 70 comprises three spaced apart bands 24, each connected to side members 22 and ultimately cantilevered members 26 and sleeve 34.

Figure 8:
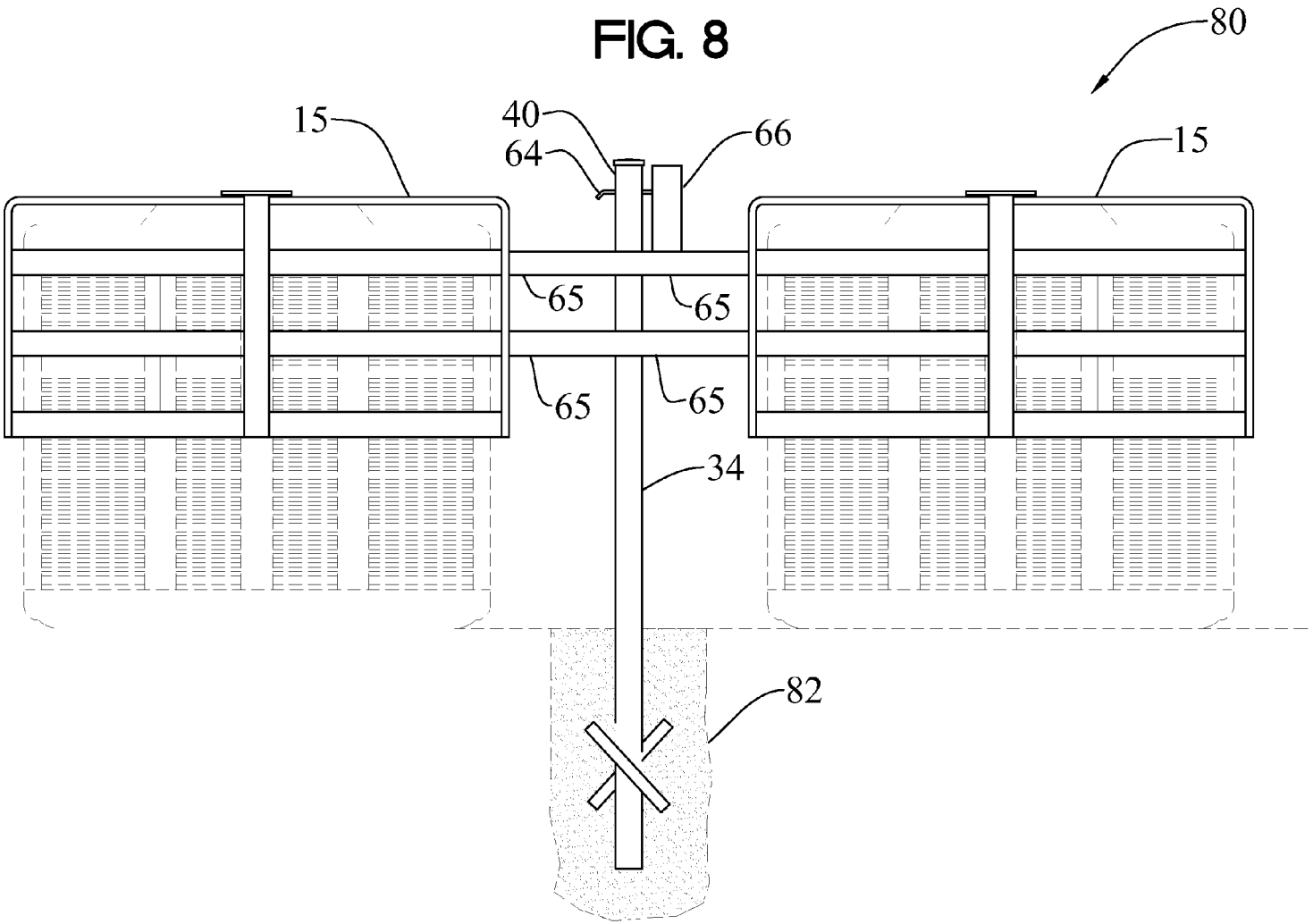
FIG. 8 is a side elevation view of another embodiment of an anti-theft apparatus.
Figure 9:
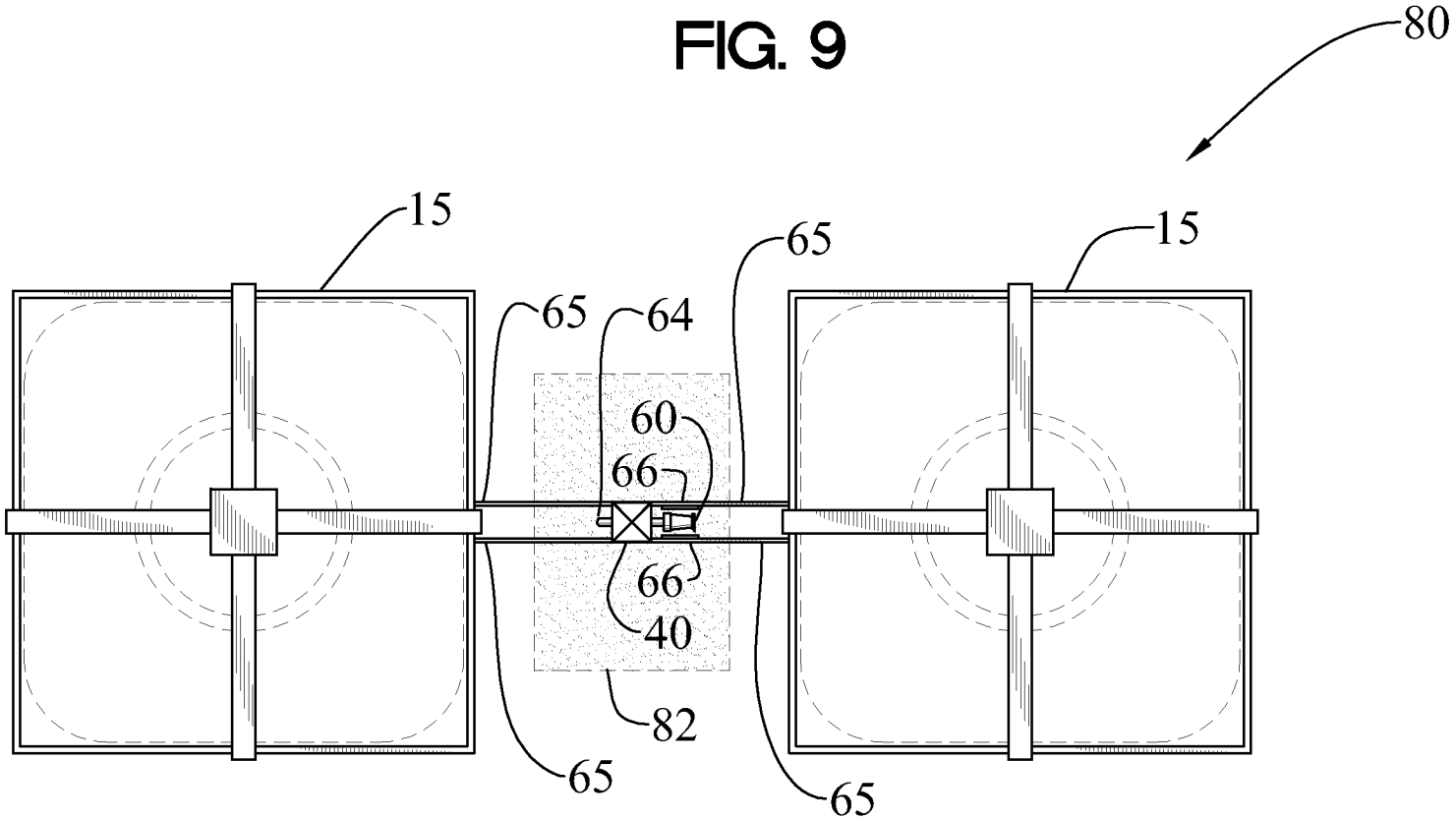
FIG. 9 is a top plan view of the embodiment shown in FIG. 8.

Cantilevered members 26 may be connected to side members 22 anywhere along the length of side members 22 and anywhere along the length of sleeve 34, and may or may not align with the one or more bands 24. As shown in the embodiment of FIGS. 1-4, cantilevered members 26 are aligned with or otherwise positioned at the same height as each respective band 24. In the embodiment of FIGS. 5-7, an upper cantilevered member 26 is positioned at the same height as a topmost band 24, while a lower cantilevered member 26 is positioned slightly offset to and above a bottom-most band 24. In the embodiment of FIGS. 8-9, cantilevered members 26 are aligned with or otherwise positioned at the same height as the upper two bands 24. Cantilevered members 26 may be connected to opposite sides of sleeve 34 or on the same side of sleeve 34, such as a side generally nearest to bands 24.

In the embodiments shown in the figures, top members 20 and side members 22 comprise bars having generally flat sides. Top members 20 and side members 22 may alternatively comprise hollow tubes or solid rods. Top members 20 and side members 22 may be fabricated into any cross-sectional shape. From end to end, top members 20 and side members 22 need not be straight, as shown in the figures, and may instead be curved, for example.

Bands 24 include members 25 that when connected to one another, are configured to encircle the article intended to be protected from theft. Each of bands 24 may be positioned generally horizontally, or they may be positioned at an angle relative to a horizontal plane. In the embodiments shown in the figures, members 25 comprise bars having generally flat sides. Members 25 may alternatively comprise hollow tubes or solid rods. Members 25 may be fabricated into any cross-sectional shape. From end to end, members 25 need not be straight, as shown in the figures, and may instead be curved, for example.

Figure 2:
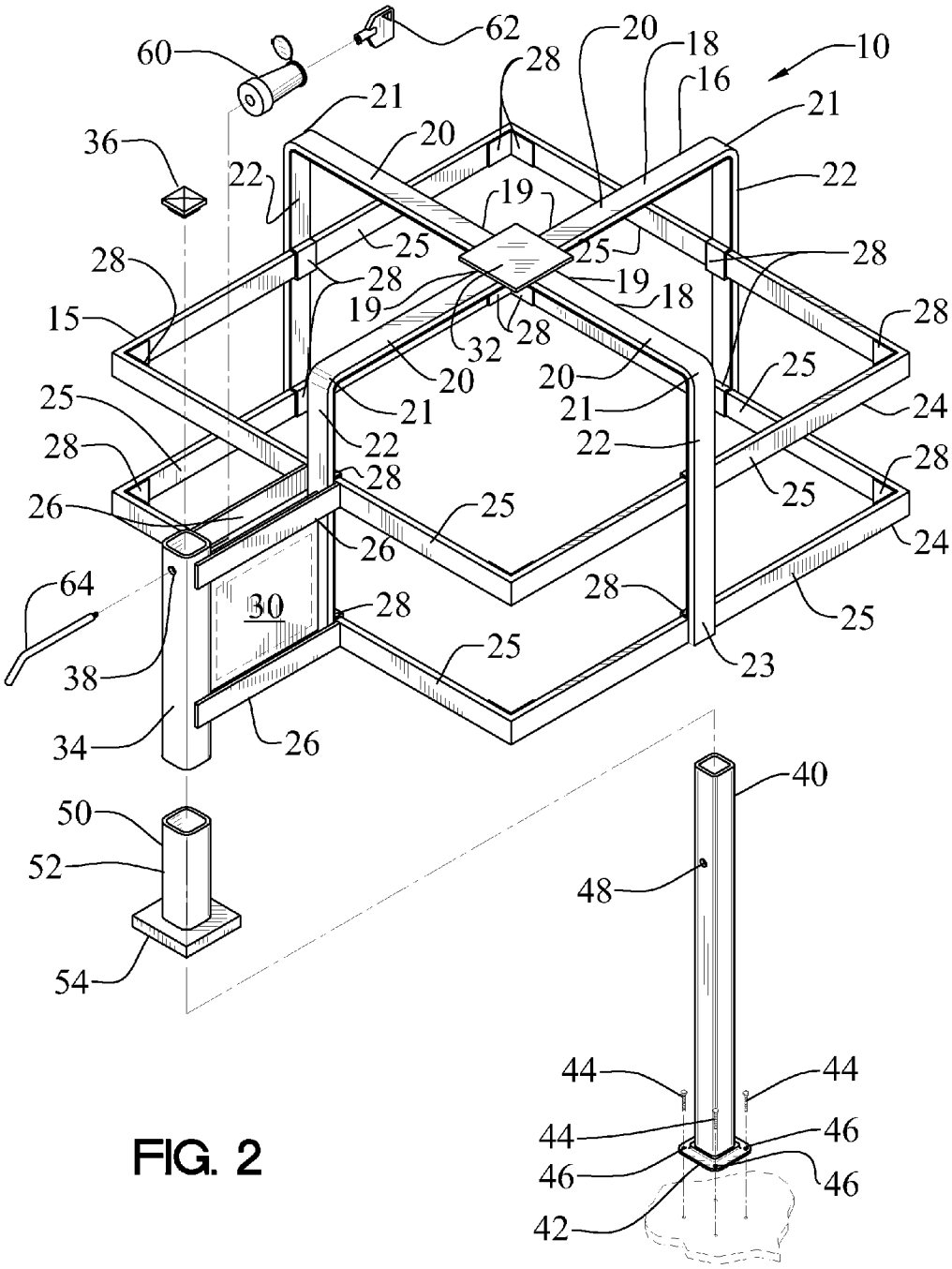
FIG. 2 is an exploded perspective view of the embodiment shown in FIG. 1.
Figure 3:
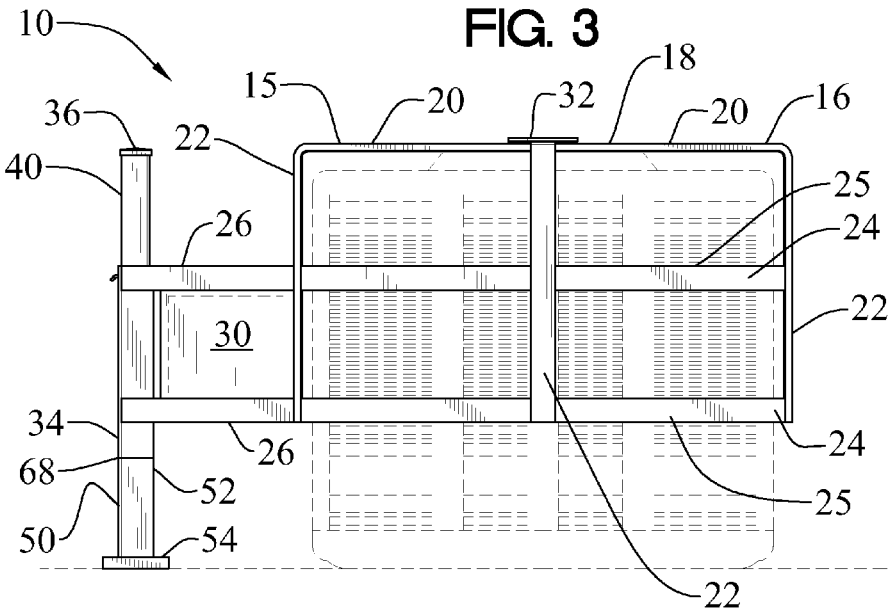
FIG. 3 is a side elevation view of the embodiment shown in FIG. 1.
Figure 4:
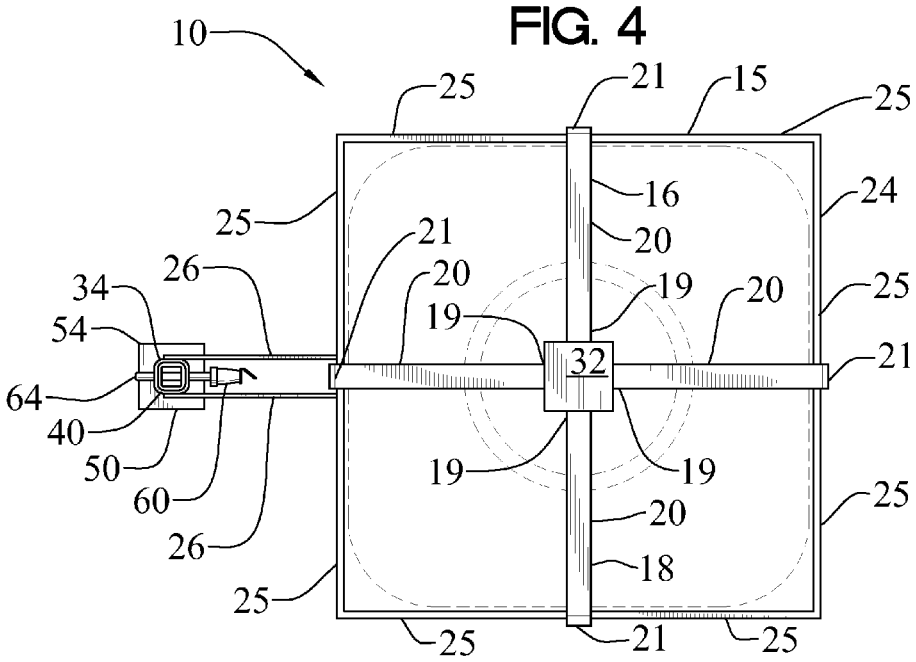
FIG. 4 is a top plan view of the embodiment shown in FIG. 1 with the post end cap removed.

As shown in FIG. 1, cantilevered members 26 connect top portion 16 to sleeve 34, which is configured for being positioned over and around post 40 when cage 15 is installed over and around an article to be protected from theft. As shown in FIGS. 1-3, one end of cantilevered members 26 are connected to sleeve 34 on opposite sides of sleeve 34 while the opposite end of cantilevered members 26 are connected to member 25 of band 24.

For strength and resistance to torsion and twisting of cage 15, cage 15 may include plate 30 connecting upper and lower cantilevered members 26 on one side of sleeve 34, and another plate 30 connecting upper and lower cantilevered members 26 on the opposite side of sleeve 34. Plates 30 positioned on opposite sides of sleeve 34 may help to at least partially encapsulate and therefore protect lock 60 from tampering.

As shown in FIGS. 1-3, sleeve 34 is configured to be positioned over post 40 during installation of cage 15 over an article to be protected from theft. To resist rotation of cage 15 while installed over post 40, post 40 and sleeve 34 may each be configured with facets, such as side walls, for nesting of the facets (or walls) together. As shown in FIGS. 1-3, post 40 and sleeve 34 each have a generally square or rectangular cross section thereby creating sidewalls on each, which resists rotation of cage 15 when sleeve 34 is installed over, and nested with post 40. In another embodiment, sleeve 34 may instead be tubular in shape to match the cross-sectional shape of a tubular or cylindrical post 40. To resist rotation of cage 15 under these circumstances, one or more sheer pins may be positioned through both walls of sleeve 34 as well as post 40.

Sleeve 34 includes a pair of apertures 38 configured to align with aperture 48 on post 40 for receiving pin 64 for securing cage 15 to post 40. In the embodiment shown in the figures, each aperture 38 is aligned with one another on opposite walls of sleeve 34. In another embodiment, apertures 38 may be positioned in adjacent walls of sleeve 34. In the embodiment shown in the figures, lock 60 operable by key 62 or comprising a random numeric or alphanumeric combination may be secured to an end of pin 64 to removably secure cage 15 over and around an article to be protected from theft. A suitable lock 60 and pin 64 may be a Trimax receiver lock model #TR200, available from Trimax Corp. at www.trimax-locks.com. A model TR200 has a ⅝" inch diameter pin with a 360° swivel, easy-access receiver lock, and is made of chrome-plated steel and has a weather tight cover.

The bottom surface of sleeve 34 is configured to abut the top surface of anchor base cover plate 50 at interface 68. Anchor base cover plate 50 comprises sleeve portion 52 and base 54 and is configured to be positioned over post 40 to conceal anchors 44 (if present), which may be used for securing post 40 to, for example, a concrete base. When installed over post 40, anchor base cover plate 50 lies between the concrete base and sleeve 34 of cage 15, the assembly being pinned and held together using pin 64 positioned through apertures 38 of sleeve 34 and aperture 48 on post 40. Base 54, which may be part of anchor base cover plate 50 or may be a separate structure, may be sized to be at least slightly larger in plan width than anchor base 42 to conceal anchors 44 and therefore deter theft of the article when base 54 of anchor base cover plate 50 is installed over post 40.

Sleeve portion 52 may have a generally square or rectangular cross section to match that of sleeve 34 and post 40. Like sleeve 34 and sleeve portion 52, post 40 may be hollow. Post 40 may alternatively be configured from a solid material. Post 40 may include anchor base 42 and apertures 46 in anchor base 42 through which anchors 44 may be positioned to secure post 40 to the concrete base. Post 40 additionally includes aperture 48 to accept pin 64 for securing cage 15 to post 40. If post 40 is hollow, it may include two apertures 48, one on either side of post 40.

Top members 20, side members 22, members 25, cantilevered members 26, plate 30, plate 32, and sleeve 34 of cage 15 may be welded or fastened together using fasteners. Anti-theft apparatus 10 may be constructed from steel or any other metal or material, such as composite materials like Kevlar, which when fabricated and installed forms a deterrent to theft of an article to be protected.

To provide insurance against scratching the article to be protected from theft, cage 15 may include padding, such as pads 28, positioned on inside surfaces of top portion 16 or the one or more bands 24 or both. Pads 28 may be made from a foam or a rubber, for example.

Turning to FIGS. 8-9, show an exemplary anti-theft apparatus 80 for deterring theft of two adjacent articles, such as a residential or a commercial outdoor air conditioner units. Anti-theft apparatus 80 comprises two cages 15 connected to sleeve 34 by cantilevered members 65, where sleeve 34 is installed over a single post 40 to deter two adjacent articles from theft. The embodiment of FIGS. 8-9 also shows enclosure 66 formed by two vertically positioned arms connected to cantilevered members 65 to at least partially surround lock 60 to provide tamper resistance to lock 60. In this way, plate 30 may not be needed to provide tamper resistance to lock 60.

Anti-theft apparatus 10,70,80 provides a sturdy anti-theft enclosure comprising cage 15 for easy installation and permitted removal without interfering with routine maintenance or operation of the article. When fully installed, cantilevered members 26, plate 30, and sleeve 34 guard against tampering of pin 64 or lock 60. End cap 36 may be affixed to cover the exposed end of post 40. Anti-theft apparatus 10,70,80 may vary in size and weight depending the article intended to be enclosed. As shown in FIG. 9, if a concrete base does not preexist adjacent to the article to be protected from theft, post 40 may be captively secured in a freshly poured concrete base 82 to avoid the need of securing post 40 to the concrete via fasteners.

To install anti-theft apparatus 10,70,80, a user may designate a location for positioning anchor base 42 near an article to be protected from theft. If clearance allows, anchor base 42 may be secured to a concrete base on any side of the article, such as an outdoor air conditioner unit. In one embodiment, post 40 may be placed at least 12 inches from an edge of the concrete to help ensure that post 40 is firmly secured to the concrete base.

To locate the positions for anchors 44, the next step is to dry-assemble anti-theft apparatus 10,70,80 over an article to be protected against theft, such as an outdoor air conditioner unit. Post 40 having anchor base 42 may be fitted through sleeve 34 of cage 15 (or vice versa) and then cage 15 may be placed over the article. With cage 15 centered over the and around the article, the concrete base may then be marked through apertures 46 of anchor base 42 of post 40 to provide the locations for drilling respective holes in the concrete base. Cage 15 may then be removed from the article and the post removed from the concrete to expose the marked locations for drilling the anchor holes.

Once the holes have been drilled to a suitable depth, post 40 may then be secured to the concrete base using anchors 44 positioned in respective apertures 46 in anchor base 42. Anchors 44 may comprise a stud/nut combination, a lead anchor/bolt combination, or any other fastener system. For example, if the concrete base is not pre-existing and is poured specifically for anchoring anti-theft apparatus 10,70,80, studs or other anchors may be inserted into the as-poured concrete for receiving post 40 when the concrete is set. Alternatively, as shown in FIG. 9, post 40 may be inserted into freshly poured concrete thereby becoming fixed to concrete base 82 when set to avoid the need for anchors 44 and anchor base cover plate 50.

With post 40 secured to the concrete base, anchor base cover plate 50 may then be positioned over post 40 to conceal anchors 44 if anchors 44 exist. Sleeve 34 of cage 15 may then be positioned over post 40 and made to rest upon the top surface of sleeve portion 52 of anchor base cover plate 50 (FIGS. 1-7) or directly on concrete base 82 (FIGS. 8-9). Cage 15 is thereby positioned over and around the article intended to be protected from theft.

Pin 64 may then be inserted through apertures 38 and 48. Lock 60 may then be secured to an end of pin 64 and positioned between respective upper cantilevered members 26. End cap 36 may then be inserted to cover exposed end of post 40.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. An anti-theft apparatus for deterring theft of an outdoor air conditioner unit, comprising:

a post; and a cage removably lockable to and cantileverly extendable from the post for removably enclosing at least a portion of the air conditioner unit, the cage comprising a top portion formed from a plurality of top members and a plurality of side members extending downwardly from respective outer ends of the top members, and a plurality of spaced apart bands oriented approximately perpendicularly and connected to respective side members of the top portion.

2. The anti-theft apparatus of claim 1, wherein the cage comprises a sleeve from which the cage is cantilevered therefrom, the sleeve having an aperture for receiving the post therethrough.

3. The anti-theft apparatus of claim 1, wherein the top members, the side members, and the spaced apart bands are formed from four-sided bars.

4. The anti-theft apparatus of claim 1, wherein an inner end of each of the top members is welded in facing association with one another.

5. The anti-theft apparatus of claim 1, wherein an outer end of each of the top members is welded to an upper end of each of the side members.

6. The anti-theft apparatus of claim 1, wherein the spaced apart bands are welded to each of the side members.

7. The anti-theft apparatus of claim 1, wherein one of the spaced apart bands is welded to a bottom end of each of the side members.

8. The anti-theft apparatus of claim 1, further including a lock removably engageable with an end of a pin that is positionable through an aperture in the cage and in the post, wherein a cantilevered portion of the cage provides tamper resistant access to the lock.

9. The anti-theft apparatus of claim 1, wherein the post is embeddable in a concrete base.

10. The anti-theft apparatus of claim 1, wherein the post is mountable to a concrete base using a plurality of anchors.

11. The anti-theft apparatus of claim 10, further comprising an anchor cover for concealing the plurality of anchors when the anchor cover is installed over the post, the anchor cover being positionable between the concrete base and the cage to provide a pedestal for the cage.

12. The anti-theft apparatus of claim 1, further comprising a plurality of cantilevered members extending from a sleeve of the cage to the top portion of the cage.

13. An anti-theft apparatus for deterring theft of an outdoor air conditioner unit, comprising:

a post mounted to a base in proximity to the unit by a plurality of fasteners;

a cover comprising a first sleeve extending from an enclosure, the cover positioned on the post via the first sleeve, the cover in mated association with the base for concealing the plurality of fasteners by the enclosure;

a cage for removably enclosing at least a portion of the air conditioner unit, the cage comprising a second sleeve positioned on the post, the second sleeve comprising a bottom surface in mated association with a top surface of the first sleeve, the cage cantileverly extending from the post by a plurality of cantilevered members attached to the second sleeve, the cage further comprising a top portion formed from a plurality of top members and a plurality of side members extending downwardly from respective outer ends of the top members, and a plurality of spaced apart bands oriented approximately horizontally and connected to respective side members of the top portion, a pin removably engaged in aligned apertures in the second sleeve and the post; and a lock removably engaged to an end of the pin, the end of the pin and the lock positioned between two of the cantilevered members to provide a tamper resistant obstruction for the lock.

14. The anti-theft apparatus of claim 13, wherein an inner end of each of the top members are in facing association with one another.

15. The anti-theft apparatus of claim 13, wherein the post has at least one facet nested with at least one facet on each of the first and second sleeves.

16. The anti-theft apparatus of claim 13, further comprising at least one plate connecting at least two cantilevered members to one another.

17. The anti-theft apparatus of claim 13, further comprising at least one pad positioned on internal surfaces of the top portion or the spaced apart bands to protect the unit from being scratched.

18. An anti-theft apparatus for deterring theft of an outdoor air conditioner unit, comprising:

a post anchorable to a ground in proximity to the unit;

a cage comprising a first sleeve for receiving the post therethrough;

a top portion formed from a plurality of top members and a plurality of side members extending downwardly from respective outer ends of the top members, a plurality of spaced apart bands oriented approximately perpendicularly to and connected to each of side members of the top portion, and a plurality of cantilevered arms connected to the first sleeve and one of the side members for cantileverly supporting the cage to enclose at least a portion of the unit; and a locking device configured to removably retain the cage upon the post.

19. The anti-theft apparatus of claim 18, further comprising a pedestal having a second sleeve for receiving the post therethrough, the pedestal configured for adjusting an installed height of the cage over the unit.

20. The anti-theft apparatus of claim 18, wherein a portion of the locking device is positioned between at least two of the cantilevered arms.

* * * * *